US007540894B2

(12) United States Patent
Ni

(10) Patent No.: US 7,540,894 B2
(45) Date of Patent: Jun. 2, 2009

(54) SUBSECTION DEDUSTING DEVICE FOR A VACUUM CLEANER

(75) Inventor: Zugen Ni, Suzhou (CN)

(73) Assignee: Suzhou Kingclean Floorcare Co., Ltd., Suzhou (CN)

( * ) Notice: Subject to any disclaimer, the term of this patent is extended or adjusted under 35 U.S.C. 154(b) by 531 days.

(21) Appl. No.: 11/397,705

(22) Filed: Apr. 5, 2006

(65) Prior Publication Data

US 2007/0089381 A1 Apr. 26, 2007

(30) Foreign Application Priority Data

Oct. 25, 2005 (CN) ..... 2005 1 0095081

(51) Int. Cl.
*B01D 45/12* (2006.01)

(52) U.S. Cl. ..... 55/345; 55/337; 55/346; 55/428; 55/DIG. 3; 15/353

(58) Field of Classification Search ..... 55/345, 55/325, 326, 322, 337, 321, DIG. 3, 346, 55/349, 428, 429; 15/353, 352
See application file for complete search history.

(56) References Cited

U.S. PATENT DOCUMENTS

2003/0200736 A1* 10/2003 Ni ..... 55/426
2006/0230722 A1* 10/2006 Oh et al. ..... 55/345

* cited by examiner

*Primary Examiner*—Duane Smith
*Assistant Examiner*—Dung Bui
(74) *Attorney, Agent, or Firm*—Oliff & Berridge, PLC

(57) ABSTRACT

This invention discloses a subsection dedusting device for a vacuum cleaner comprising an upper cyclone separator including a wind outlet and several lower cyclone separators located below said upper cyclone separator, wind inlets of said lower cyclone separators in fluid communication with said wind outlet of said upper cyclone separator, thereby increasing wind quantity while reducing the whole bulk of the machine, and keeping a relatively high dedusting efficiency, and besides the lower cyclone separator of the present invention adopts a pervasion construction, and air flow rotates in a decelerated and acentric state in the conical barrel, thereby the pressure loss of the air flow is little, and accordingly, obtain a good dust suction effect.

3 Claims, 3 Drawing Sheets

SUBSECTION DEDUSTING DEVICE FOR A VACUUM CLEANER

FIELD OF INVENTION

The present invention relates to a subsection dedusting device for a vacuum cleaner.

BACKGROUND OF THE INVENTION

One traditional vacuum cleaner is arranged with a filter device for filtering suctioned dust-laden air, and leaving dust particles in a dust collecting device, so that the filter device should be cleaned or replaced after used for a period of time, otherwise, fine dust may clog filter holes of the filter device, which will increase resistance of the dedust motor, even burn the motor out, thereby not only bringing trouble for users, but also adversely affecting performance and life-span of the vacuum cleaner.

In recent years, a cyclonic dedusting device is widely used in vacuum cleaner instead of the filter device by manufacturers according to the principle of cyclone separation, which has obtained a relatively fine dedusting effect. The cyclonic dedusting device mounts a conical barrel with a large upper end and a relatively small lower end in the dust cup, a wind outlet tube is vertically disposed at the upper end of the conical barrel, the lower end of the conical barrel is opened so as to allow dust to drop into the bottom of the dust cup, a wind inlet tube enters into a side wall of an upper portion of the conical barrel along a tangent direction, so that the dust-laden air flow entering the conical barrel through the wind inlet tube produces cyclone and the dust particles drop into a bottom of a dust collecting barrel along the side wall of the conical barrel due to centrifugal force caused by cyclonic air flow, finally only dust-free air flow is upwardly discharged into the atmosphere through the wind outlet tube.

However, the cyclonic dedusting device has a relatively large bulk, especially a cyclonic dedusting device used for a large vacuum cleaner requiring a relatively large air flow has a larger bulk, which not only increases manufacturing cost thereof, but also brings much inconvenience for users.

BRIEF SUMMARY OF THE INVENTION

An object of the present invention is to provide a subsection deducting device for a vacuum cleaner, which includes an upper cyclone separator and several lower cyclone separators, a wind outlet of the upper cyclone separator communicated with wind inlets of the several lower cyclone separators, thereby increasing wind quantity while without increasing the whole bulk of the machine, and keeping a relatively high dedusting efficiency.

In one aspect of the present invention, it is provided with a subsection deducting device for a vacuum cleaner, which includes an upper cyclone separator and several lower cyclone separators, the lower cyclone separators are located below the upper cyclone separator, and a wind outlet of the upper cyclone separator is communicated with wind inlets of the several lower cyclone separators.

In another aspect of the present invention, it is provided with a subsection deducting device for a vacuum cleaner, which includes an upper cyclone separator and several lower cyclone separators, the lower cyclone separators are located below the upper cyclone separator, and a wind outlet of the upper cyclone separator is communicated with wind inlets of the several lower cyclone separators. The upper cyclone separator includes a cylinder dust cup having a cyclone wind inlet, a cylinder filter cover with pores thereon is coaxially arranged in the cylinder dust cup, top end openings of the cylinder dust cup and the cylinder filter cover are sealed by a top cover, a bottom end opening of the cylinder filter cover is used as a wind outlet of the upper cyclone separator and is located at a lower end of the cylinder dust cup. The lower cyclone separator includes a conical barrel and a cylinder barrel having a cyclone wind inlet, the cylinder barrel is connected to a small end of the conical barrel, and the cylinder barrel coaxially mounts a wind outlet tube.

In still another aspect of the present invention, it is provided with a subsection deducting device for a vacuum cleaner, which includes an upper cyclone separator and several lower cyclone separators, the lower cyclone separators are located below the upper cyclone separator, and a wind outlet of the upper cyclone separator is communicated with wind inlets of the several lower cyclone separators. The upper cyclone separator includes a cylinder dust cup having a cyclone wind inlet, a cylinder filter cover with pores thereon is coaxially arranged in the cylinder dust cup, top end openings of the cylinder dust cup and the cylinder filter cover are sealed by a top cover, a bottom end opening of the cylinder filter cover is used as a wind outlet of the upper cyclone separator and is located at a lower end of the cylinder dust cup. The lower cyclone separator includes a conical barrel and a cylinder barrel having a cyclone wind inlet, the cylinder barrel is connected to a small end of the conical barrel, and the cylinder barrel coaxially mounts a wind outlet tube. A wind outlet cover is provided between the upper cyclone separator and the several lower cyclone separators, and a wind exhaust tube is provided in the side face of the wind outlet cover, the wind outlet tubes located in respective cylinder barrels at an upper portion of the nine lower cyclone separators are upwardly communicated with the wind outlet cover, the several cylinder barrels are connected with each other side by side to form a wind guiding member, the cyclone wind inlets on the cylinder barrels are communicated with the wind guiding member, the wind outlet of the upper cyclone separator extends below through the wind outlet cover to be communicated with the wind guiding member. A side portion of the cylinder dust cup defines a dust collecting opening, and the dust collecting opening is communicated with a dust collecting barrel, a lower portion of the dust collecting barrel projects to form a circular dust collecting barrel located below the upper cyclone separator, the lower cyclone separators are encircled about the circle dust collecting barrel. A lower portion of the conical barrel is provided with an umbrella reflecting plate, a center of the umbrella reflecting plate defines a refluence hole, a ring gap for dropping-dust is defined between the peripheral of the umbrella reflecting plate and a side wall of the conical barrel, a bottom of the conical barrel is connected to a dust collecting barrel, a bottom cover is arranged below several dust collecting barrels.

The advantages of the present invention are as follows:

1. The present invention includes an upper cyclone separator and several lower cyclone separators, a wind outlet of the upper cyclone separator communicated with wind inlets of the several lower cyclone separators, thereby increasing wind quantity while without increasing a whole bulk of the machine, and keeping a relatively high dedusting efficiency.

2. In the prior art, the conical barrel of the lower cyclone separator is a funnel shape, and the cyclone wind inlet is located in a large end at a top portion thereof, so that the lower cyclone separator separates dust by accelerated rotation of air flow, thus, pressure loss of air flow is relatively great, which adversely affects dust suction effect of the vacuum cleaner, and furthermore, the accelerated air flow may easily raise again the fine dust which have dropped to a bottom of the dust cup, and the raised fine dust will be discharged to the outside through the wind outlet tube together with the air flow, thereby resulting in secondary pollution. However, the lower cyclone separator of the present invention adopts a pervasion construction, the conical barrel has a configuration with a small top end and a large bottom end, the cyclone wind inlet is located at the small top end, so that air flow rotates in a decelerated and acentric state in the conical barrel, thereby the pressure loss of the air flow is little, and accordingly, obtain a good dust suction effect.

3. The rotation speed of air flow in the lower portion of lower cyclone separator of the present invention is slower than that in the upper portion thereof, thereby preventing dust on the bottom of the dust cup from being raising again, without causing secondary pollution.

BRIEF DESCRIPTION OF THE DRAWINGS

The present invention will be further described blow in conjunction with the drawings and the embodiments.

Figure 1:
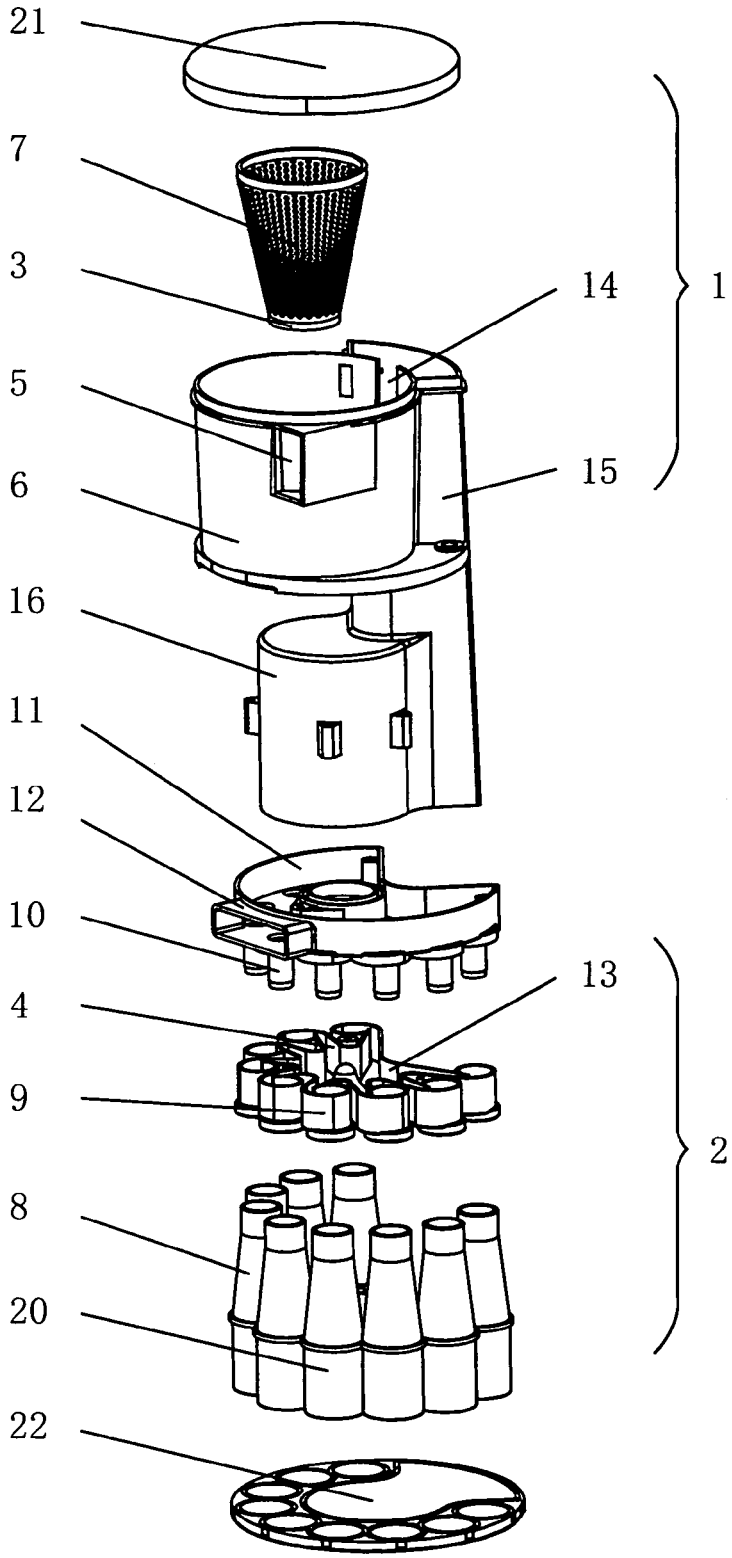
FIG. 1 is an exploded schematic view of the present invention.

In the drawings: 1 upper cyclone separator; 2 lower cyclone separator; 3 wind outlet; 4 cyclone wind inlet; 5 cyclone wind inlet; 6 cylinder dust cup; 7 cylinder filter cover; 8 conical barrel; 9 cylinder barrel; 10 wind outlet tube; 11 wind outlet cover; 12 wind exhaust tube; 13 wind guiding member; 14 dust collecting opening; 15 dust collecting barrel; 16 cylinder dust collecting barrel; 17 umbrella reflecting plate; 18 refluence hole; 19 ring gap for dropping-dust; 20 dust collecting barrel; 21 top cover; 22 bottom cover

DESCRIPTION OF THE PREFERRED EMBODIMENTS

Figure 2:
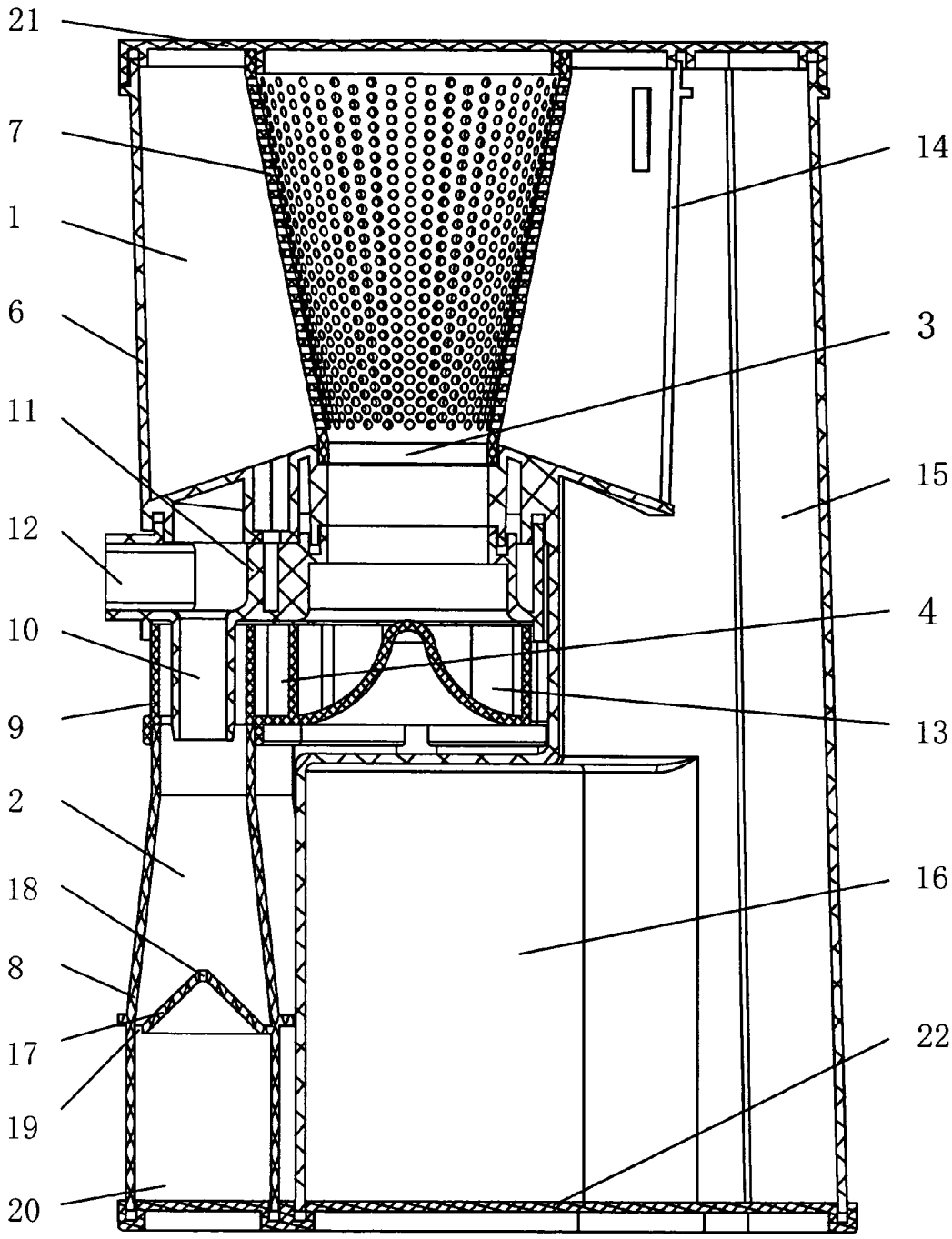
FIG. 2 is a front cross-sectional view of the present invention.
Figure 3:
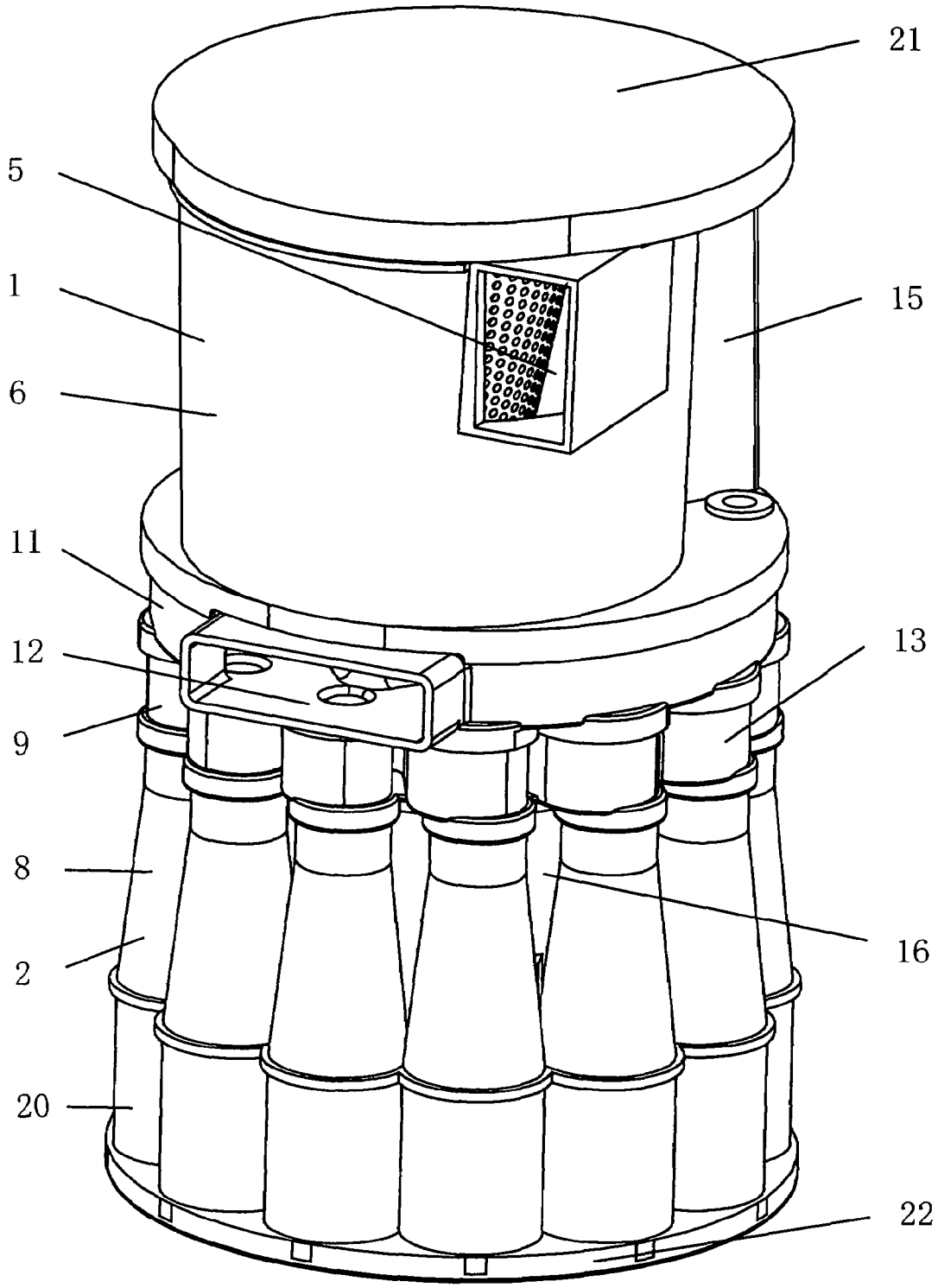
FIG. 3 is a solid view of the present invention showing the exterior configuration thereof.

Embodiments: referring to FIGS. 1, 2, and 3, a subsection dedusting device for a vacuum cleaner, comprises an upper cyclone separator 1 and nine lower cyclone separators 2, and the lower cyclone separators 2 are located below the upper cyclone separator 1, the upper cyclone separator 1 includes a cylinder dust cup 6 having a cyclone wind inlet 5. A cylinder filter cover 7 with pores thereon is coaxially arranged in the cylinder dust cup 6, top end openings of the cylinder dust cup 6 and the cylinder filter cover 7 are sealed by a top cover 21, a bottom end opening of the cylinder filter cover 7 is used as a wind outlet 3 of the upper cyclone separator 1 and is located at a lower end of the cylinder dust cup 6. A dust collecting opening 14 is defined on a side portion of the cylinder dust cup 6, which is communicated with a dust collecting barrel 15, a circular dust collecting barrel 16 projects out of the lower portion of the dust collecting barrel 15 and is located below the upper cyclone separator 1, so that the nine lower cyclone separators 2 are encircled about the circle dust collecting barrel 16.

Each lower cyclone separator 2 includes a cylinder barrel 9 located upside and having a cyclone wind inlet 4, and a conical barrel 8 located underside, the cylinder barrel 9 is connected to a small end of the conical barrel 8, the cylinder barrel 9 coaxially mounts a wind outlet tube 10, a lower portion of the conical barrel 8 is provided with a umbrella reflecting plate 17, a center of the umbrella reflecting plate 17 defines a refluence hole 18, a ring gap 19 for dropping-dust is defined between the peripheral of the umbrella reflecting plate 17 and a side wall of the conical barrel 8, a dust collecting barrel 20 is connected to the conical barrel 8 at the bottom thereof, and a bottom cover 22 is arranged below several dust collecting barrels 20.

A wind outlet cover 11 is provided between the upper cyclone separator 1 and the nine lower cyclone separators 2, and a wind exhaust tube 12 is provided in the side face of the wind outlet cover 11, the wind outlet tubes 10 located in respective cylinder barrels 9 at an upper portion of the nine lower cyclone separators 2 are upwardly communicated with the wind outlet cover 11, the nine cylinder barrels 9 are connected with each other side by side to form a wind guiding member 13, the cyclone wind inlets 4 on the cylinder barrels 9 are communicated with the wind guiding member 13, the wind outlet 3 of the upper cyclone separator 1 extends below through the wind outlet cover 11 to be communicated with the wind guiding member 13.

During operation, the dust-laden air flows into the cylinder dust cup 6 through the cyclone wind inlet 5, so that coarse dust enters the dust collecting barrel 15 via the dust collecting opening 4, and air together with fine dust further enters the inside of the cylinder filter cover 7 and flows across through the wind outlet cover 11 from the wind outlet opening 3 into the wind guiding member 13, and further enters the cylinder barrel 9 of each lower cyclone separator 2, to form cyclone. During cyclone, fine dust drops along an inner wall of the conical barrel 8 to the bottom of the dust collecting barrel 20 via the ring gap 19, and after dust is removed, air from the refluence hole 18 then upwardly enters the wind outlet cover 11 via the wind outlet tube 10, and is discharged to the atmosphere through the wind exhaust tube 12 of the wind outlet cover 11.

Having thus described the above embodiments , the invention is now claimed to be:

1. A subsection dedusting device for a vacuum cleaner comprising:

an upper cyclone separator including:

a wind outlet;

a cylinder dust cup having a cyclone wind inlet, and a cylinder filter cover with pores thereon coaxially arranged in said cylinder dust cup, wherein top end openings of said cylinder dust cup and said cylinder filter cover are sealed by a top cover, and a bottom end opening of said cylinder filter cover is located at a lower end of the cylinder dust cup and functions as the wind outlet of said upper cyclone separator, a side portion of said cylinder dust cup defining a dust collecting opening in communication with a dust collecting barrel;

several lower cyclone separators located below said upper cyclone separator, wind inlets of said lower cyclone separators being in fluid communication with the wind outlet of said upper cyclone separator, wherein said lower cyclone separators include:

a conical barrel and a cylinder barrel having a cyclone wind inlet, and said cylinder barrel is connected to a small end of said conical barrel;

a wind outlet tube is coaxially mounted in said cylinder barrel; and an umbrella reflecting plate positioned at lower portion of said conical barrel, and a refluence hole defined at the center of said umbrella reflecting plate, and a ring gap for dropping-dust is defined between the peripheral of said umbrella reflecting plate and a side wall of said conical barrel, and a bottom of said conical barrel being connected to said dust collecting barrel, and a bottom cover is arranged below several said dust collecting barrels; and a wind outlet cover provided between said upper cyclone separator and said several lower cyclone separators, and a wind exhaust tube provided in the side face of said wind outlet cover, and said wind outlet tubes are located in respective cylinder barrels at an upper portion of said lower cyclone separators upwardly communicated with said wind outlet cover, wherein said several cylinder barrels are connected with each other side by side to form a wind guiding member, and said cyclone wind inlets on said cylinder barrels communicated with said wind guiding member, said wind outlet of said upper cyclone separator extending below through said wind outlet cover to be communicated with said wind guiding member.

2. The subsection dedusting device for a vacuum cleaner of claim 1 wherein a lower portion of said dust collecting barrel projects to form a circular dust collecting barrel located below said upper cyclone separator, said lower cyclone separators encircled about the circular dust collecting barrel.

3. A subsection dedusting device for a vacuum cleaner comprising:

an upper cyclone separator including:

a wind outlet;

a cylinder dust cup having a cyclone wind inlet, and a cylinder filter cover with pores thereon coaxially arranged in said cylinder dust cup, wherein a side portion of said cylinder dust cup defines a dust collecting opening in communication with a dust collecting barrel; and several lower cyclone separators located below said upper cyclone separator, wind inlets of said lower cyclone separators being in fluid communication with the wind outlet of said upper cyclone separator.

* * * * *